United States Patent [19]

Piat-Marchand

[11] 3,954,077

[45] May 4, 1976

[54] TRIMARANS

[76] Inventor: Michel Gaston Jean Piat-Marchand, 28, rue de Lagny, 77 Dampmart, France

[22] Filed: May 12, 1972

[21] Appl. No.: 252,870

[30] Foreign Application Priority Data

May 14, 1971 France ..... 71.17517
Mar. 10, 1972 France ..... 72.08382

[52] U.S. Cl. ..... 114/123; 267/69
[51] Int. Cl.[2] ..... B63B 43/14
[58] Field of Search ..... 114/121, 122, 123, 125, 114/39, 66.5 F, 43.5; 244/100, 104; 267/63, 73, 153, 69, 72; 9/1 R

[56] References Cited

UNITED STATES PATENTS

| | | | |
|---|---|---|---|
| 1,054,851 | 3/1913 | Leblond | 114/123 |
| 1,615,568 | 1/1927 | Carroll | 267/69 |
| 1,773,999 | 8/1930 | Haight | 114/43.5 |
| 3,150,632 | 9/1964 | Evans | 114/123 |
| 3,304,898 | 2/1967 | Sainte-Claire | 114/123 |

*Primary Examiner*—Trygve M. Blix
*Assistant Examiner*—Charles E. Frankfort
*Attorney, Agent, or Firm*—Ulle C. Linton

[57] ABSTRACT

An arrangement for preventing the capsizing of trimaranes, and to facilitate their righting, comprising a main hull, two stabilizing hulls pivotally connected to the main hull by a pair of arms and further including a pair of extensible elastic members to restrain the upward movement of the stabilizing hulls and a plurality of flexible, non-extensible members to restrain the downward movement of the stabilizing hulls.

3 Claims, 8 Drawing Figures

TRIMARANS

The present invention relates to improvements in trimarans.

Trimarans have three hulls, of which the outer ones, which generally have the same shape as the main hull, constitute very effective stabilizing floats and said trimarans are fast under sail.

The present invention, which intends to improve these qualities still further, is remarkable in that the floats, of small capacity, may contain a liquid which, when transferred from one float to the other, serves to ballast the windward float and their efficiency is therefore doubled.

As a result:

1. Weight is reduced
2. There is no heel, hence the sail is used with maximum efficiency
3. The wetted surface is reduced.

The first concern is increased speed for the boat.

According to another characteristic of the invention, the floats are situated at the end of arms articulated on the hull.

Other characteristics and advantages will appear more clearly in the description which follows, made in reference to the drawings attached by way of example only, and in which.

Figure 1:
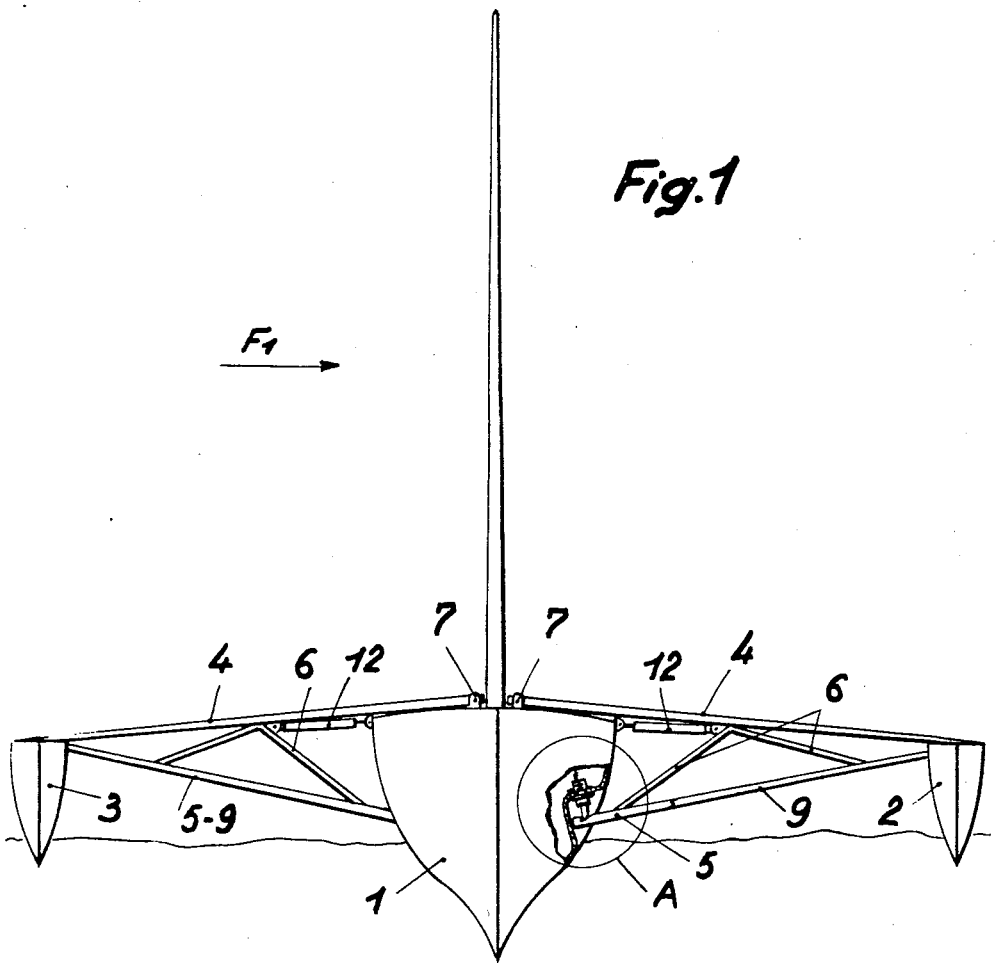
FIG. 1 is a front view partly in section, of a trimaran according to the invention

Referring now to the drawings, in which like and corresponding parts are indicated by the same reference characters, the trimaran is constituted by a hull 1, with two identical, lateral floats 2 and 3, connected to said hull by rigid arms 4, 5 contained in a vertical plane with each of the pairs of arms 4-5 being joined by cross-braces 6.

According to the present invention, each of the floats 2 and 4 is constituted by a hollow, tight, body which can contain a liquid that makes a substantial contribution to the weight of the float. The floats are connected by at least one pipe extending to the bottom of each of the floats and permitting the transfer of the liquid.

Each water-pipe is matched in parallel by an air pipe connecting the two floats at their upper edges. An air pump can be connected to this air pipe to compress the air in either of the floats to prime the siphon, forcing the liquid to take to the connection pipe. The air pipe can debouch in the open air in order to pick up a quantity of liquid proper for consumption with a view to transferring it to the auxillary tank in the hold in hull 1.

Each float can comprise several water and air tight compartments, connected to the corresponding compartment in the other float in the manner described above with the set of air pipes being placed under the control of an appropriate pump. This arrangement makes it possible to ship different liquids such as fresh water, gasoline, etc.

Figure 2:
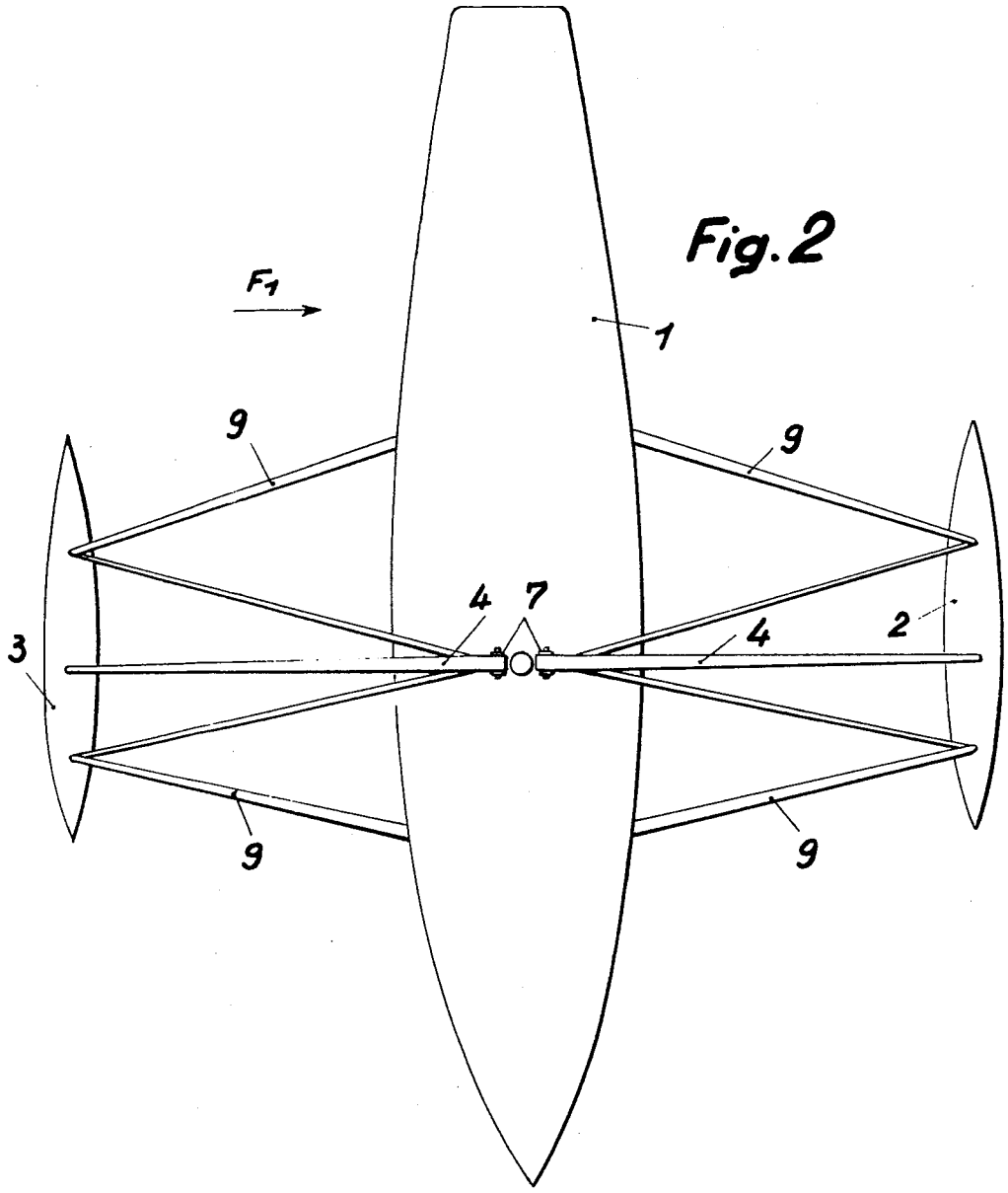
FIG. 2 is a top view thereof
Figure 4:
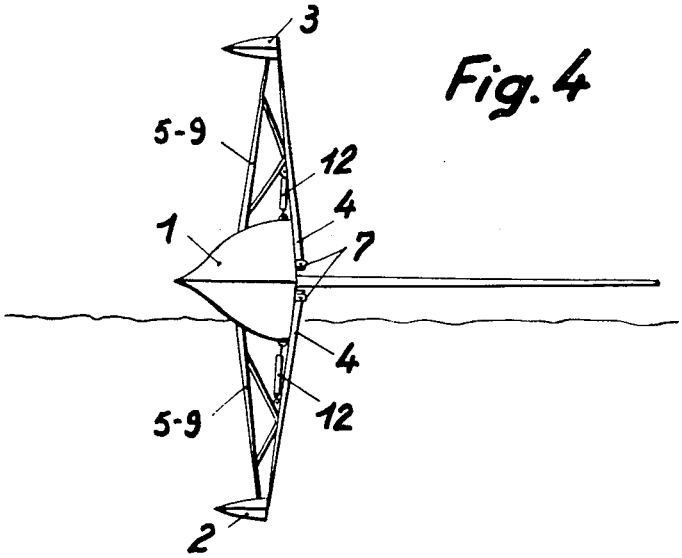
FIGS. 4 and 5 are views on a smaller scale showing the way in which the capsized trimaran is righted.

The device works as follows:

The departure of the trimaran from land is made under reduced sail with the two floats balanced fifty-fifty and the assembly is then working as a conventional trimaran. Now assume that the pilot wishes to follow a course such that the wind is blowing to starboard (arrow $F_1$ and FIG. 2). In this case it is necessary to shift a certain volume of liquid from float 2 to float 3, to lighten the first float and ballast the second float. With the water pipeline primed, all that is needed to do is to heel the vessel deliberately so that the level of the float to be emptied will be situated above the level of the liquid contained in the float to be ballasted.

It is therefore necessary to take a heading such that the wind will blow to port in order to create a slight unbalance and then the valves are opened. The operation continues until the boat is balanced for the heading desired and then the valves are closed and the course changed. It should be noted that the operation is done slowly enough to allow for errors on the part of the pilot, controlling the balance of the boat by acting on the rudder. This device therefore does have the result of completely eliminating the heeling of the boat, and reducing the wetted surface, which is the cause of a substantial amount of drag. This phenomenon is utilized whenever the balance is upset, that is to say when there is a change in the strength of the wind or a change in course of the boat.

According to other characteristics of the invention, each of the floats can pivot around an axis situated substantially in the median plane of the vessel. For this reason, upper arms 4 are articulated between hinges 7, while the ends of lower arms 5 enter the hull 1 through openings 8 situated above the water line. Other lower arms 9, to the front and the rear of the trimaran, rest on the hull in a shaped part thereof, to insure good rigidity for the structure, and to prevent the floats from dropping below the water line.

Figure 3:
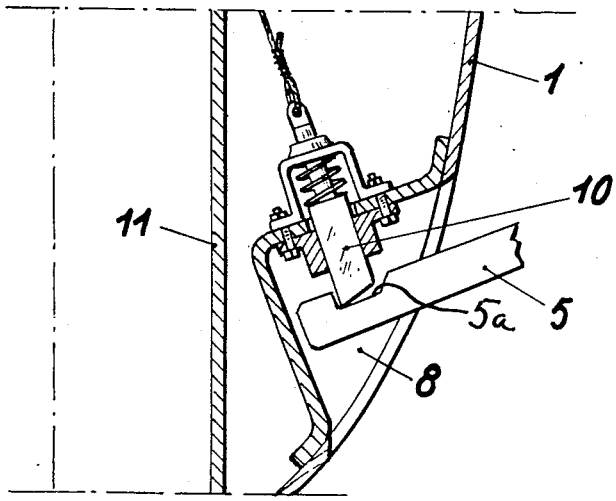
FIG. 3 is a sectional view on a larger scale of detail A of FIG. 1

A lock 10 slideably mounted in hull 1 at openings 8, as shown in FIG. 3, normally counteracts the pivoting of the arms by engaging recesses 5*a* in said arm. A partition 11, forming a well, extending to the level of the gunnel, isolates this portion of the hull.

Figure 5:
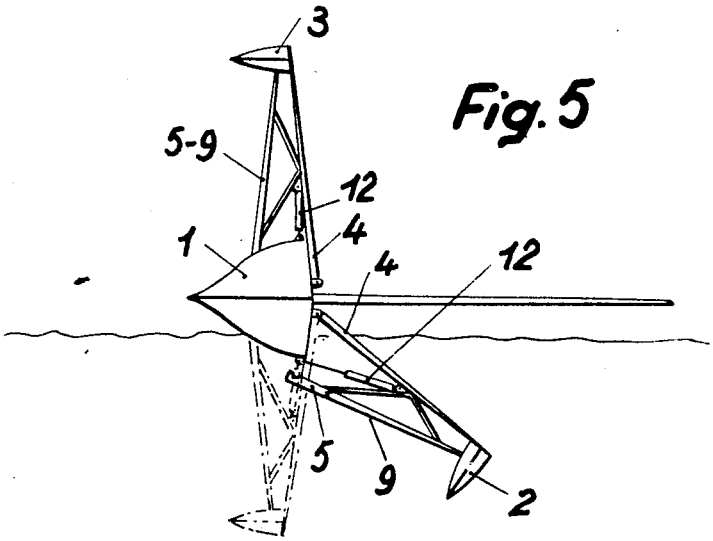

Means are provided to limit the rotation of the arms 4-5, such as hydraulic dampers 12 which are pivotally connected to the upper arms 4 and the hull 1. This device has the function of permitting the vessel to be lifted if it heels, (FIG. 5).

It works as follows:

When the wind is blowing to starboard according to arrow $F_1$, the float 3 is ballasted and float 2 is empty, the wind is too strong for the amount of canvas carried by the vessel, which is strained to its utmost.

The pilot has the float release cable for lock 10 within reach, and as soon as the boat is heeling to a dangerous degree, but before it capsizes float 2, which is empty, float 2 is released and rises back to the surface. Locked at 45° by the dampers 12, float 2 rights the boat at 45°. In this position, the boat must then be steered in such a way as to diminish the effect of the lateral force of the wind. Float 3, which is ballasted, terminates the righting while float 2 returns to its position by its own weight and is automatically locked. This event merely causes a slowing down.

In the unthinkable event that the ballasted float were in the water and the empty float in the air, it would be necessary to use the pump to shift liquid from the ballasted float to the empty one.

Figure 6:
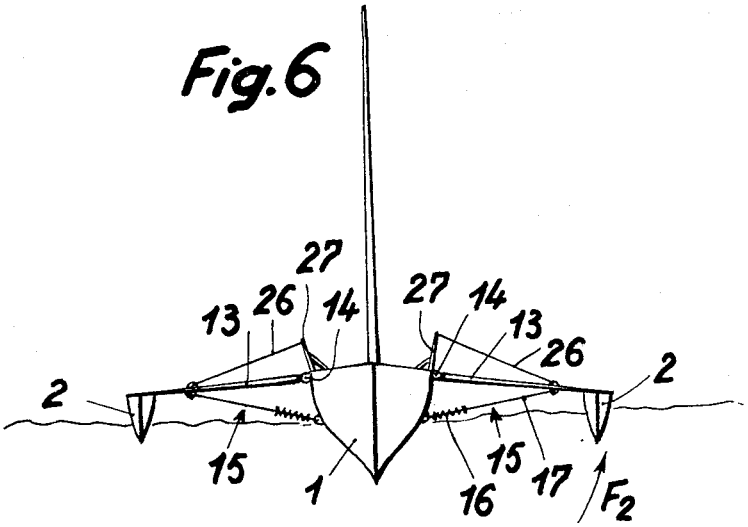
FIG. 6 is a front view of a trimaran according to a second embodiment.
Figure 7:
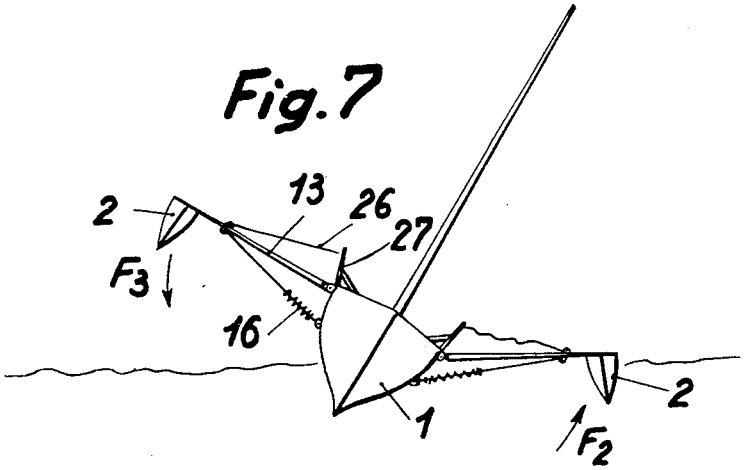
FIG. 7 is a view similar to FIG. 6, but showing how the device works in a capsizement of the vessel.
Figure 8:
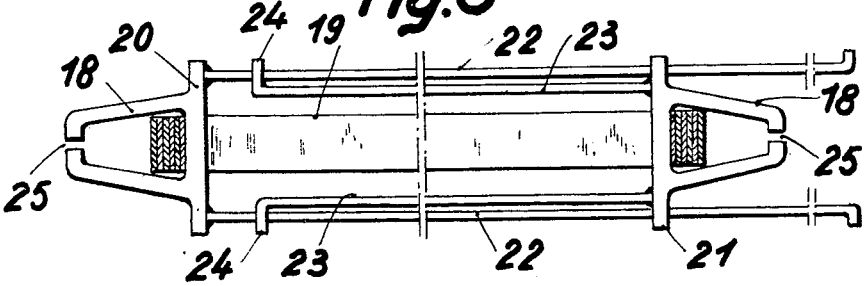
FIG. 8 is a view on a larger scale showing a device embodying an extensible tie-rod.

FIGS. 6 to 8 show a modification in which floats 2 are connected to hull 1 by two rigid arms 13, articulated to hull 1 at 14. Each of the arms 13 is connected to the hull 1 by means of flexible extensible members 15.

If, as the result of heeling by the vessel, a float tends to sink, the ascending force to which it is exposed, forces it to return to the surface. If the heel is considerable and constant, the ascending force mentioned above increases, and the arm pivots according to arrow $F_2$, which draws out member 15, making hull 1 pivot in the same direction, doing so before the boat has reached a dangerous degree of heel.

Member 15 is preferably made in two parts, the extensible part being constituted by a structure 16 such as the one shown, for example, in FIG. 8, while the other is constituted by a non-extensible flexible cable 17.

The assembly 16 is essentially constituted by two rings 18 joined together by rubber straps 19. Rings 18 are provided with bars 20 and 21, respectively, bar 20 including two parallel rods 22, the free ends of which pass through bar 21, while bar 21 has two other parallel-rods 23, whose free ends 24 are traversed by said rods 22.

Each of the rings 18 has a slot 25 for introduction of straps 19.

When the boat assumes a substantial angle of heel, the float which is out of the water tends to pivot abruptly according to arrow $F_3$ (FIG. 7) and its arm 13 threatens to strike the hull 1, which could cause damage to the latter. To remedy this drawback each of the arms 13 is held by a flexible and non-extensible member 26 fixed on said arm by one of its ends, and onto an auxiliary mast 27 by its other end with the length of the members 26 being such that members 15 will be stretched (FIG. 6).

The invention is not, of course, limited to the method of embodiment described and represented, on the contrary it extends to all variants of form, material and dimensions.

Thus the extensible assembly can be constituted by a pneumatic device.

What I claim is:

1. Trimaran comprising in combination a hull, a pair of floats, a pair of arms each being pivotally connected to said hull and fixedly attached to one of said floats, a pair of extensible elastic members each being connected to said hull and one of said arms and capable of elastically restraining the upward movement of its corresponding float, and a plurality of flexible and non-extensible members each connecting one of said arms to said hull and capable of restraining said arm from pivoting downwardly.

2. Trimaran comprising, in combination, a hull, a pair of floats, a pair of arms each having an end portion pivotally connected to said hull and a second end portion fixedly attached to one of said floats, a pair of elastic members each being attached by one end portion to the second end portion of one of said arms and having a second end portion attached to said hull and capable of elastically opposing the pivoting upwardly of its corresponding float, said members each having an extensible elastic portion and an inextensible flexible cable being connected to said extensible portion, and a plurality of flexible and non-extensible members each connecting one of said arms to said hull and capable of restraining said arm from pivoting downwardly.

3. Trimaran comprising in combination, a hull, a pair of floats, a pair of arms each being pivotally connected to said hull and fixedly attached to one of said floats, a pair of extensible elastic members each being connected to said hull and one of said arms and capable of elastically restraining the upward movement of its corresponding float, each of said elastic member having a pair of rings, an elastic band connecting said rings, each of said rings having a bar, a pair of parallel rods being connected to one of said bars and slidably extending through the other of said bars, a second pair of rods being connected to said other of said bars and having lateral ends with said first pair of rods slideably extending through said lateral ends, one of said rings being connected to said hull and cable connecting the other of said rings to its respective one of said arms.

* * * * *